US007568413B2

(12) United States Patent
Chen

(10) Patent No.: US 7,568,413 B2
(45) Date of Patent: Aug. 4, 2009

(54) CUTTING APPARATUS

(75) Inventor: Lu-Yang Chen, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 149 days.

(21) Appl. No.: 11/819,346

(22) Filed: Jun. 27, 2007

(65) Prior Publication Data

US 2009/0000448 A1 Jan. 1, 2009

(51) Int. Cl.
*B26D 7/06* (2006.01)

(52) U.S. Cl. ..... 83/424; 83/471; 242/615.3

(58) Field of Classification Search ..... 83/424, 83/471; 242/526, 615.3
See application file for complete search history.

(56) References Cited

U.S. PATENT DOCUMENTS 2,827,961 A * 3/1958 Pugh ..... 242/525
3,733,230 A * 5/1973 Prittie ..... 156/64
3,803,959 A * 4/1974 Rung ..... 83/18
3,858,474 A * 1/1975 Kuts ..... 83/424
4,014,233 A * 3/1977 Wolfinger et al. ..... 83/156
6,892,976 B2 * 5/2005 Foo et al. ..... 242/531

* cited by examiner

*Primary Examiner*—Sang Kim
(74) *Attorney, Agent, or Firm*—Rosenberg, Klein & Lee

(57) ABSTRACT

A cutting apparatus includes a frame having a front surface and a back surface. A first receiving member for receiving a crude belt film is configured on a front surface of the frame. A second receiving member for receiving an amended belt film is configured on the front surface of the frame and is parallel with the first receiving member. A motive device which is used for rewinding the amended belt film connects with the second receiving member. A first guide member includes a guide plate and a locating plate. The guide plate is disposed on the locating plate, and the locating plate is fixed on the front surface of the frame. A guide recess is defined on a top surface of the guide plate. A cutting tool that is arranged on the frame includes a cutter, and a knifepoint of the cutter is received in the guide recess.

12 Claims, 5 Drawing Sheets

CUTTING APPARATUS

BACKGROUND OF THE INVENTION

1. Field of the Invention

The present invention relates to a cutting apparatus, and more particularly to a cutting apparatus for cutting a belt film into a given width.

2. The Related Art

Recently, different kinds of belt films are broadly used in varieties of products. A film adhesive tape named Mylar is a polyester film adhesive tape. The Mylar adhesive tape has many excellent characteristics of high intensity, high tenacity, fine insulation, fine diaphaneity and so on. Then the Mylar adhesive tape is widely used in an electric machinery, a transformer, a printed circuit, an integrated circuit or the like.

However, the size of a belt film a manufacturer provides is specific. If a user needs different sizes of the belt film, two methods are usually to choose to solve the problem. On one hand the user has to return the belt film to the manufacturer and request the manufacturer to have the belt film made to order, or on the other hand the user has to utilize a conventional cutter and a ruler to amend the belt film in order to satisfy the request of a product. The shortcomings of the former are that the manufacturer may refuse to yield the specific size of the belt film because the amount of the belt film is not too many, or the manufacturer agrees to yield the specific size of the belt film but the price the manufacturer demands is too high and it is not economical for the user. The shortcomings of the latter are that the efficiency is low, and the quality of the belt film which is amended is not good, so it wastes manpower, and further causes the material resource wasted.

SUMMARY OF THE INVENTION

An object of the present invention is to provide a cutting apparatus for cutting a belt film into a given width. The cutting apparatus includes a frame having a front surface and a back surface. A first receiving member for receiving a crude belt film is configured on the front surface of the frame. A second receiving member for receiving an amended belt film is configured on the front surface of the frame and is parallel with the first receiving member. A motive device which is used for rewinding the amended belt film connects with the second receiving member. A guide member includes a guide plate and a locating plate. The guide plate is disposed on the locating plate, and the locating plate is further fixed on the front surface of the frame. A guide recess is defined on a top surface of the guide plate. A cutting tool that is arranged on the front surface of the frame includes a cutter, and a knifepoint of the cutter is received in the guide recess.

When the crude belt film needs to amend, the crude belt film is placed on the first receiving member. Then, pull out the head of the crude belt film and cut apart the head in accordance with the width that a user needs. Subsequently, put the crude belt film in the guide recess of the guide member, and cause the cutter located at the bifurcation of the head of the crude belt film. Draw the crude belt film forward and then the crude belt film is amended. Lead the amended belt film and wind the head of the amended belt film on a roller which is placed on the second receiving member. Then operate the motive device and bring the crude belt film cut apart continually by the cutter. The design of the cutting apparatus is simply. Using the cutting apparatus to cut the crude belt film can enhance the efficiency and improve the quality of the amended belt film.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
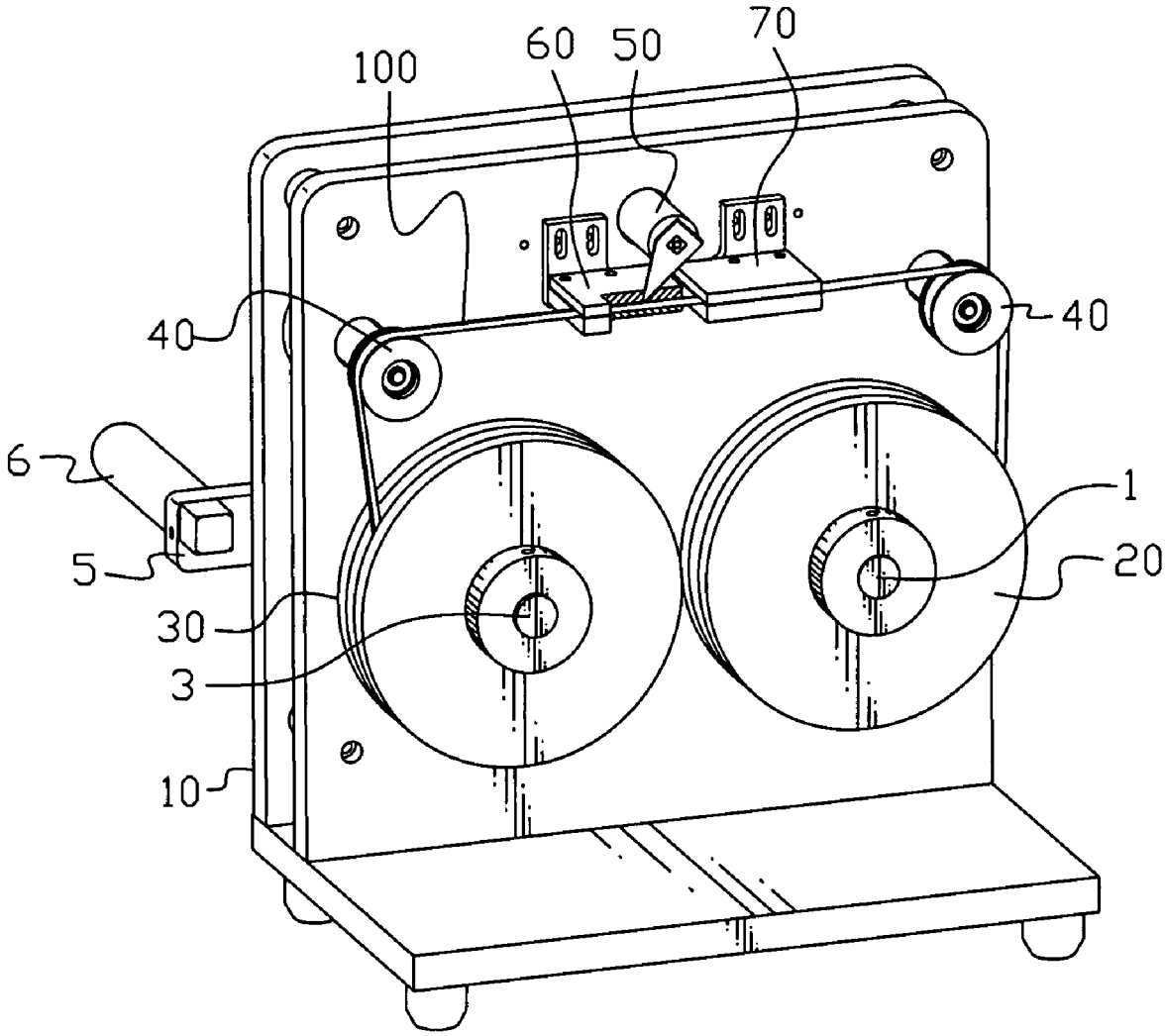
FIG. 1 is a perspective view of a cutting apparatus according to the present invention, where in order to distinctly show a cutter cutting a belt film, a guide plate and a guide couple plate are segmented partly.

Please refer to FIG. 1. A cutting apparatus in accordance with the present invention includes a frame 10. A first receiving member 20 and a second receiving member 30 are configured on the same side of the frame 10 and the two receiving members 20, 30 are parallel with each other. A pair of directive members 40 is defined on the outside of the frame 10 and above the first receiving member 20 and the second receiving member 30 respectively. A first pair of guide members 60 and a second pair of guide members 70 are arranged on the frame 10 and are between the two directive members 40. A cutting tool 50 is formed on the frame 10 and is above the guide members 60, 70. All of these will be described in detail hereinafter.

Figure 2:
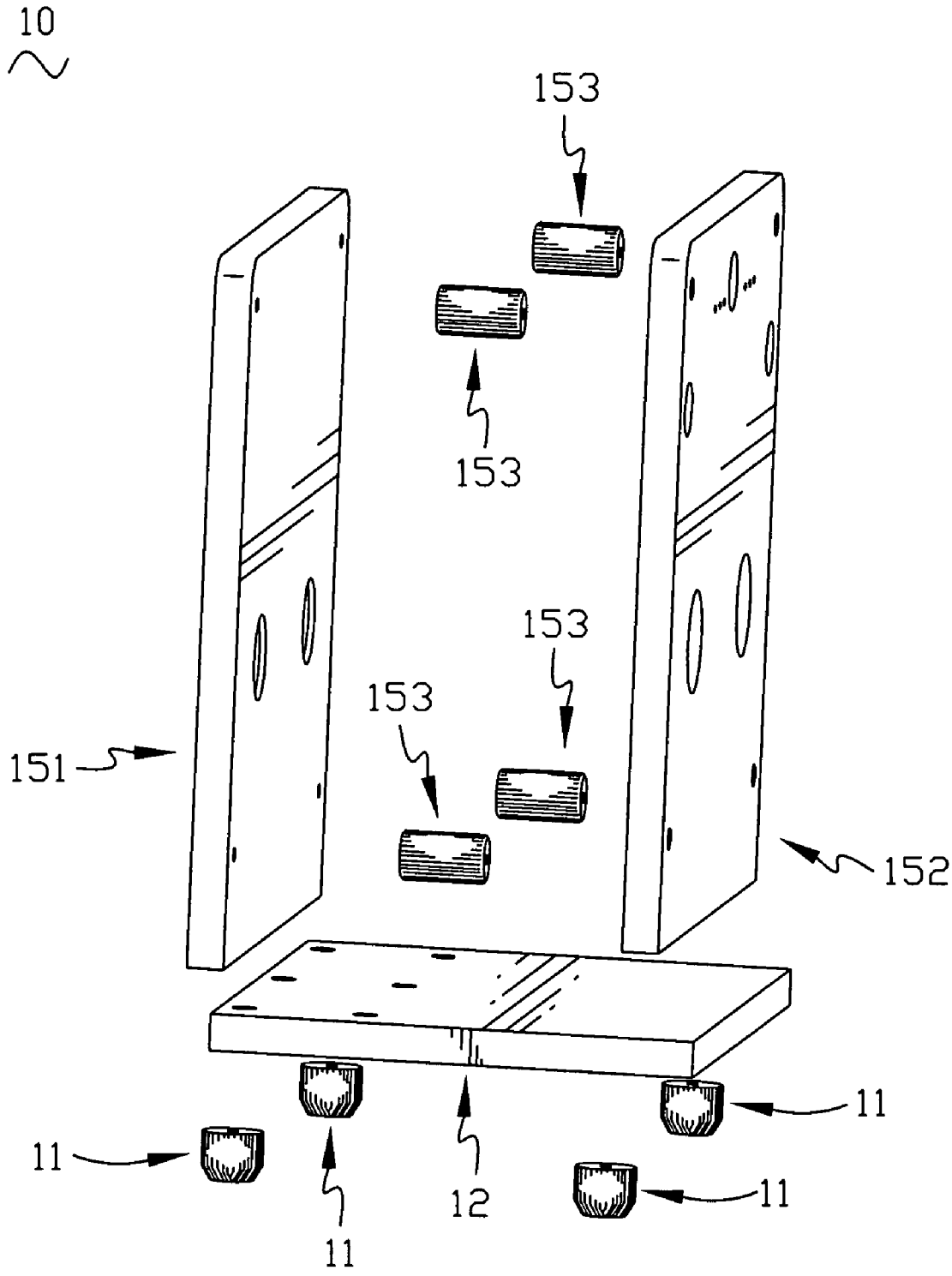
FIG. 2 is an exploded view of a frame of the cutting apparatus.

Referring to FIG. 1 and FIG. 2, the frame 10 provides a bottom board 12. Four cylinder-shaped pedestals 11 are configured on four corners of one side of the bottom board 12 symmetrically for supporting the whole bottom board 12. One end of the other side of the bottom board 12 receives a pair of basic boards designated a front basic board 152 and a back basic board 151, and the two basic boards are parallel with each other. Two pairs of supporting pillars 153 are arranged between the front basic board 152 and the back basic board 151 and integrate the front basic board 152 and the back basic board 151 together. Thereinto, one pair of the supporting pillars 153 are defined on top of the two basic boards and the other pair of the supporting pillars 153 are defined on bottom of the two basic boards.

Figure 5:
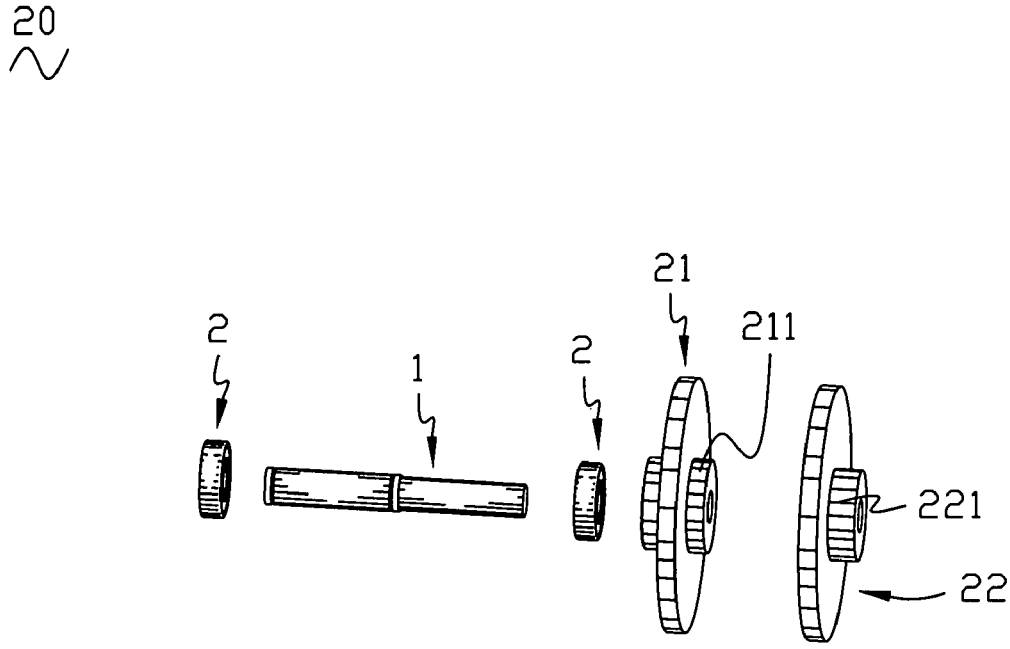
FIG. 5 is an exploded view of a first receiving member for receiving a crude belt film of the cutting apparatus.
Figure 6:
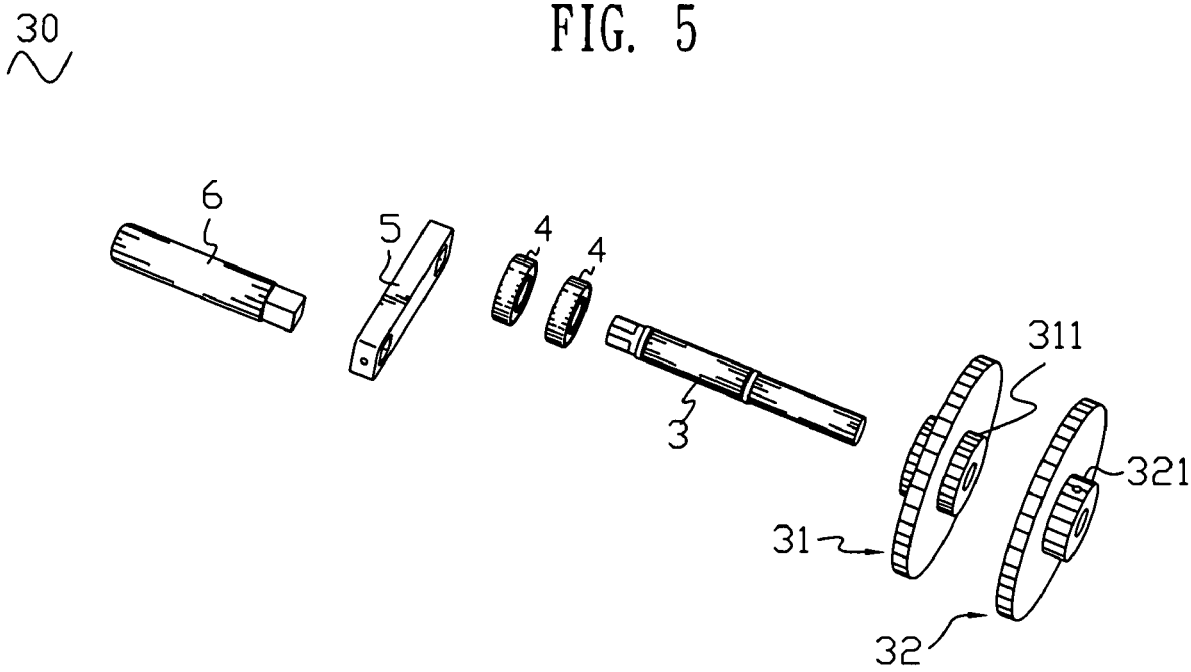
FIG. 6 is an exploded view of a second receiving member for receiving an amended belt film of the cutting apparatus.
Figure 8:
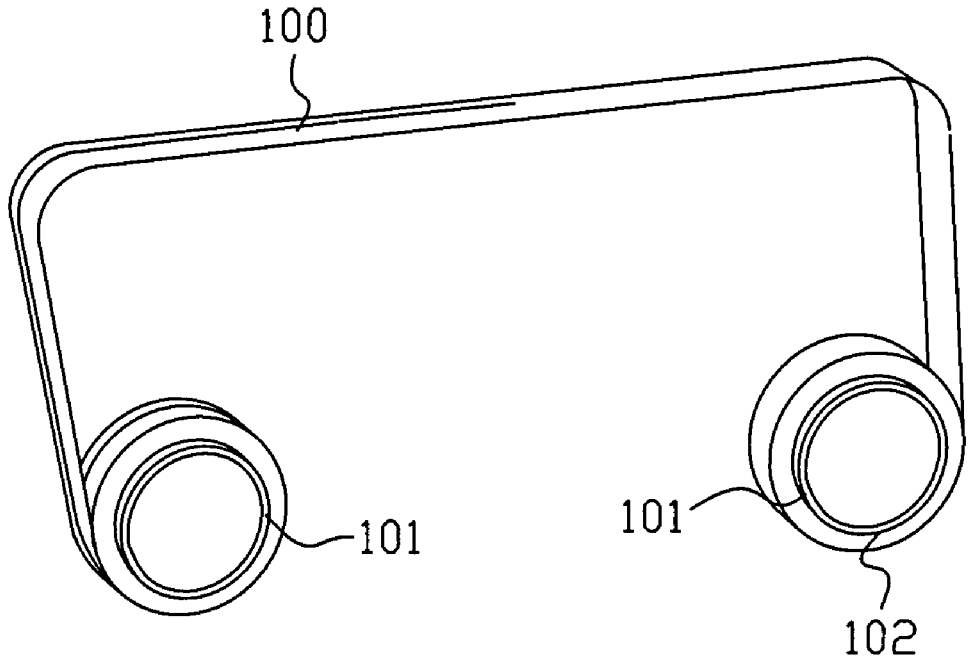
FIG. 8 is a perspective view showing the cooperation between the first receiving member and the second receiving member.

Referring to FIG. 1, FIG. 5, FIG. 6 together with FIG. 8, the first receiving member 20 is used for receiving a crude belt film 102 and the second receiving member 30 is used for receiving an amended belt film 100. The first receiving member 20 and the second receiving member 30 have partial same structures. Each receiving member includes an axle 1, 3. The axle 1, 3 passes through the back basic board 151 and the front basic board 152, and is fixed on the back basic board 151 and the front basic board 152 via a pair of bearings 2, 4. A turntable is arranged on the axle 1, 3 and is before a front surface of the front basic board 152. Every turntable includes a chief tray 21, 31 and a sub-tray 22, 32. A tube-shaped accommodating portion 211, 311 protrudes around an axle center of the chief tray 21, 31 and toward a back surface of the sub-tray 22, 32. A front surface of the sub-tray 22, 32 protrudes forward to form a fixing portion 221, 321. The chief tray 21, 31 and the sub-tray 22, 32 are parallel configured on the axle 1, 3 to form the turntable, and the accommodating portion 211, 311 is blocked between the chief tray 21, 31 and the back surface of the sub-tray 22, 32. The difference between the first receiving member 20 and the second receiving member 30 is that the second receiving member 30 further includes a connecting bar 5 and a shaft 6. One end of the connecting bar 5 connects with the end of the axle 3 perpendicularly and one end of the shaft 6 connects with the other end of the connecting bar 5 perpendicularly.

Figure 7:
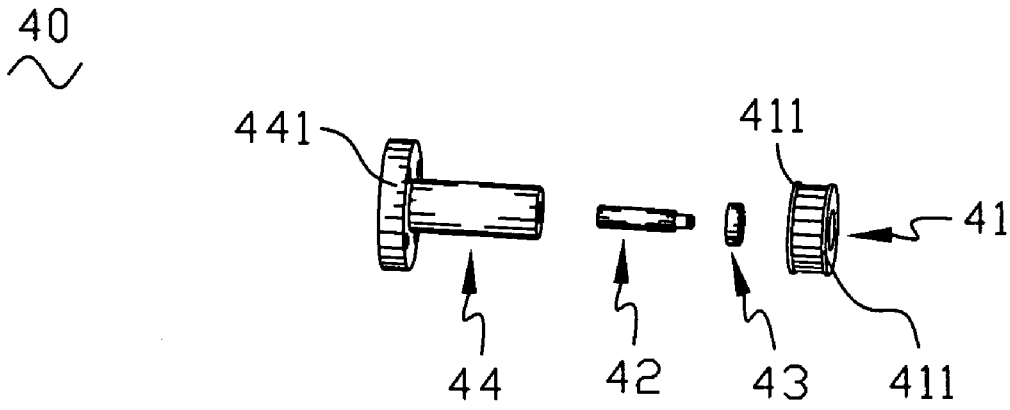
FIG. 7 is an exploded view of a directive member of the cutting apparatus.

With reference to FIG. 1 and FIG. 7, each directive member 40 includes a locating column 44. One end of the locating column 44 combines a mounting flange 441 which is located on a back surface of the front basic board 152, and the other end of the locating column 44 is hollow and stretches out of the front surface of the front basic board 152. One end of a wheel spindle 42 is inserted in the locating column 44 and the other end receives a directive wheel 41 by a retaining bearing 43. The directive wheel 41 is before the front surface of the front basic board 152. Both peripheries of the directive wheel 41 extend outward to form a preventing wall 411. The two directive members 40 are on the same level and above the first receiving member 20 and the second receiving member 30 respectively.

Figure 4:
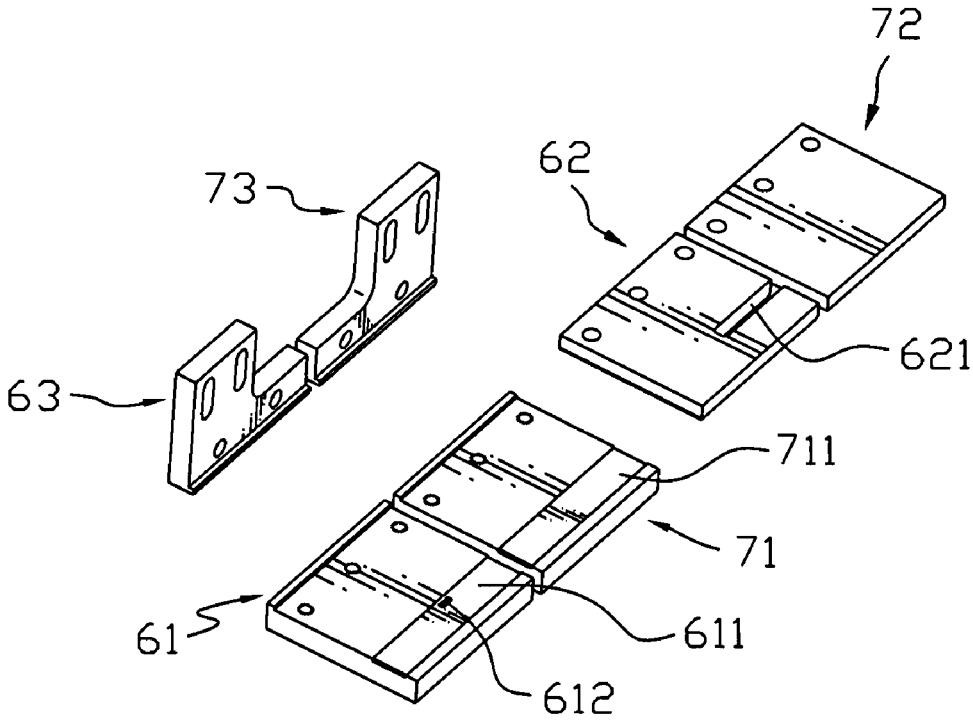
FIG. 4 is an exploded view of two pairs of guide members of the cutting apparatus.

Referring to FIG. 1 and FIG. 4, the first guide members 60 and the second guide members 70 are located on the front surface of the front basic board 152 and at the middle of the two directive members 40. The first guide members 60 include a guide plate 61 which is board-shaped. The guide plate 61 defines a guide recess 611 at a top surface thereof. At an inner side of the guide recess 611, a receiving recess 612 is formed in the bottom of the guide recess 611. A guide couple plate 62 is covered on the guide plate 61. The guide couple plate 62 defines a cutter slot 621 as the same line of the receiving recess 612. The guide plate 61 and the guide couple plate 62 are located on a locating plate 63, and the locating plate 63 is configured on the front surface of the front basic board 152. The second guide members 70 are adjacent to the first guide members 60. The second guide members 70 have an auxiliary guide plate 71, and an auxiliary guide recess 711 is defined on a top surface of the auxiliary guide plate 71. An auxiliary guide couple plate 72 is covered on the auxiliary guide plate 71. The auxiliary guide plate 71 and the auxiliary guide couple plate 72 are located on an auxiliary locating plate 73, and the auxiliary locating plate 73 is located on the front surface of the front basic board 152. The bottoms of the guide recess 611 and the auxiliary guide recess 711 and the top surface of the directive wheel 41 are on the same level. The first guide members 60 and the second guide members 70 can flatten the crude belt film 102 and the amended belt film 100.

Figure 3:
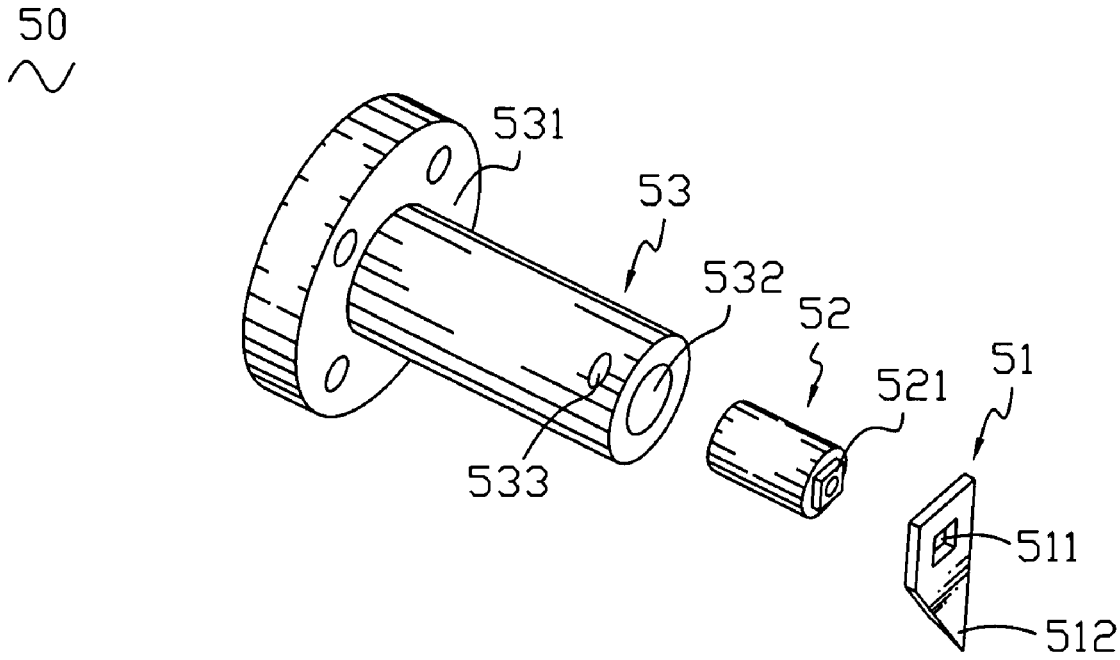
FIG. 3 is an exploded view of a cutting tool of the cutting apparatus.

Please refer to FIG. 3 as well as FIG. 1. The cutting tool 50 that is arranged between the locating plate 63 and the auxiliary locating plate 73 includes a column-shaped cutter mounting 53. One end of the cutter mounting 53 employs a circular flange 531. The cutter mounting 53 stretches out of the front surface of the front basic board 152 and the flange 531 is fixed on the back surface of the front basic board 152. A front surface of the cutter mounting 53 defines an axis hole 532 at center thereof. The side of the cutter mounting 53 defines a locating hole 533 that connects with the axis hole 532. A cutter hilt 52 is inserted in the axis hole 532 and located in the axis hole 532 through a screw (not show) inserting in the locating hole 533. A front surface of the cutter hilt 52 defines a square-shaped install portion 521 to configure a cutter 51. An upper portion of the cutter 51 is quadrate and defines a square-shaped install hole 511 at center to couple with the install portion 521 to dispose the cutter 51 on the cutter hilt 52. A lower portion of the cutter 51 is an inverted right triangle whose vertex angle is a knifepoint 512 which is used to cut the crude belt film 102 into a given width. The blade of the cutter 51 is received in the cutter slot 621 and the knifepoint 512 of the cutter 51 is further inserted in the receiving recess 612. The cutter 51 is inclined relative to the guide couple plate 62. The angle of inclination is between 25-65 degrees. Adjusting the length that the cutter hilt 52 inserts in the axis hole 532 of the cutter mounting 53 can alter the distance between the cutter 51 and the front surface of the front basic board 152. That is, the structure of the cutting tool 50 can satisfy the request of different widths of a belt film.

Refer to FIG. 1 and FIG. 8. When the crude belt film 102 needs to amend, the crude belt film 102 which is winded on a roller 101 is placed on the accommodating portion 211 of the first receiving member 20. The roller 101 is departed from the crude belt film 102 and is located on the accommodating portion 311 of the second receiving member 30. Then, pull out the head of the crude belt film 102 and cut apart the head in accordance with the width that a user needs. Subsequently, put the bifurcate head on the directive wheel 41 of the directive member 40 which is above the first receiving member 20 in order to lead the crude belt film 102 beforehand. Then, put the crude belt film 102 in the auxiliary guide recess 711 of the second guide members 70 and the guide recess 611 of the first guide members 60, and cause the cutter 51 located at the bifurcation of the head of the crude belt film 102. Draw the crude belt film 102 forward and then the crude belt film 102 is amended. Lead the amended belt film 100 through the other directive wheel 41 of the directive member 40 which is above the second receiving member 30, and wind the head of the amended belt film 100 on the roller 101. Then operate the shaft 6 and bring the crude belt film 102 cut apart continually by the cutter 51. Because the cutting tool 50 can be adjusted, it satisfies different requests of the user. The design of the cutting apparatus is simply. Using the cutting apparatus to cut the crude belt film 102 enhances the efficiency and improves the quality of the amended belt film 100.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A cutting apparatus, comprising:

a frame, having a front surface and a back surface;

a first receiving member, for receiving a crude belt film, configured on the front surface of the frame;

a second receiving member, for receiving an amended belt film, configured on the front surface of the frame and paralleling the first receiving member;

a motive device, connecting with the second receiving member for rewinding the amended belt film;

a first guide member, including a guide plate and a locating plate, the guide plate disposed on the locating plate, and the locating plate fixed on the front surface of the frame, a guide recess defined on a top surface of the guide plate; and a cutting tool, arranged on the front surface of the frame, including a cutter, a knifepoint of the cutter received in the guide recess.

2. The cutting apparatus as claimed in claim 1, further comprising a pair of directive members, defined on the front surface of the frame and above the first receiving member and the second receiving member respectively.

3. The cutting apparatus as claimed in claim 2, wherein the directive member includes a locating column, one end of the locating column combines a mounting flange which is located on the back surface of the frame, and the other end of the locating column is hollow and stretches out of the front surface of the frame, one end of a wheel spindle is inserted in the locating column and the other end receives a directive wheel by a retaining bearing, the directive wheels are above the first receiving member and the second receiving member respectively, the top surface of the directive wheel and the bottom of the guide recess are on the same level.

4. The cutting apparatus as claimed in claim 3, wherein both peripheries of the directive wheel extend outward to form a preventing wall.

5. The cutting apparatus as claimed in claim 1, further comprising a second guide member located on the frame and adjacent to the first guide member, the second guide member including an auxiliary guide plate, and an auxiliary guide recess defined on a top surface of the auxiliary guide plate, the auxiliary guide plate located on an auxiliary locating plate, and the auxiliary locating plate located on the front surface of the frame.

6. The cutting apparatus as claimed in claim 1, wherein the guide plate is coupled with a guide couple plate, the guide couple plate defines a cutter slot.

7. The cutting apparatus as claimed in claim 6, wherein the cutter is above the guide couple plate, and the cutter is inclined relative to the guide couple plate, the angle of inclination is between 25-65 degrees, the blade of the cutter is received in the cutter slot and the knifepoint of the cutter is further inserted in a receiving recess defined in the guide recess.

8. The cutting apparatus as claimed in claim 1, wherein the cutting tool includes a cutter mounting, the cutter mounting defines an axis hole at center thereof, a cutter hilt is inserted and located in the axis hole, a front end of the cutter hilt configures the cutter.

9. The cutting apparatus as claimed in claim 8, wherein the cutter has a quadrate upper portion disposed on the cutter hilt, and an inverted right triangle lower portion whose vertex angle is the knifepoint.

10. The cutting apparatus as claimed in claim 1, wherein the first receiving member and the second receiving member include an axle which is located on the frame and a turntable is arranged on the axle, every turntable includes a chief tray and a sub-tray, a tube-shaped accommodating portion protrudes around the axle center of the chief tray and toward a back surface of the sub-tray, a front surface of the sub-tray protrudes forward to form a fixing portion, the chief tray and the sub-tray are parallel configured on the axle to form the turntable, and the accommodating portion is blocked between the chief tray and the back surface of the sub-tray.

11. The cutting apparatus as claimed in claim 10, wherein the motive device comprising a connecting bar and a shaft, one end of the connecting bar connecting with the axle of the second receiving member perpendicularly and the shaft connecting with the other end of the connecting bar perpendicularly.

12. The cutting apparatus as claimed in claim 1, wherein the frame provides a bottom board, four pedestals are configured on four corners of one side of the bottom board symmetrically, one end of the other side of the bottom board receives a front basic board and a back basic board, and the two basic boards are parallel with each other, two pairs of supporting pillars are arranged between the front basic board and the back basic board and integrate the front basic board and the back basic board together, one pair of the supporting pillars defined on top of the two basic boards and the other pair of the supporting pillars defined on bottom of the two basic boards.

* * * * *